US006390357B1

(12) United States Patent
Ogryzlo et al.

(10) Patent No.: US 6,390,357 B1
(45) Date of Patent: May 21, 2002

(54) CONTAINER WITH LONGITUDINAL PASSAGEWAYS

(75) Inventors: Michael Marian Ogryzlo, Richmond; Gregory Felix Koch, Tsawwassen, both of (CA)

(73) Assignee: Corrugated Synergies International, LLC, Renton, WA (US)

( * ) Notice: Subject to any disclaimer, the term of this patent is extended or adjusted under 35 U.S.C. 154(b) by 101 days.

(21) Appl. No.: 09/634,711

(22) Filed: Aug. 7, 2000

(30) Foreign Application Priority Data

Mar. 8, 2000 (CA) ..... 2300228

(51) Int. Cl.[7] ..... B65D 21/032; B65G 57/03

(52) U.S. Cl. ..... 229/120; 206/509; 229/168; 229/916; 414/802

(58) Field of Search ..... 229/120, 120.1, 229/167, 168, 915, 916; 206/509, 511; 493/162, 405; 414/802

(56) References Cited

U.S. PATENT DOCUMENTS

| | | | | | |
|---|---|---|---|---|---|
| 1,946,315 | A | * | 2/1934 | Ferguson | 229/120 |
| 2,894,672 | A | * | 7/1959 | Bamburg | 229/120 |
| 3,352,472 | A | * | 11/1967 | Cummings et al. | 229/120 |
| 3,516,593 | A | * | 6/1970 | Larsen | 229/168 |
| 3,539,094 | A | * | 11/1970 | O'Connor et al. | 229/167 |
| 4,341,339 | A | * | 7/1982 | Zore | 229/167 |
| 4,709,852 | A | | 12/1987 | Stoll | |
| 4,770,339 | A | | 9/1988 | Weimer | |
| 5,002,224 | A | | 3/1991 | Muise | |
| 5,029,709 | A | * | 7/1991 | Faulstick | 229/167 |
| 5,277,360 | A | * | 1/1994 | DeMott | 229/167 |
| 5,370,303 | A | | 12/1994 | Fry | |
| 5,458,283 | A | | 10/1995 | Southwell et al. | |
| 5,516,034 | A | * | 5/1996 | Jensen et al. | 229/120 |
| 5,593,087 | A | | 1/1997 | Ross et al. | |
| 5,690,275 | A | | 11/1997 | Bose et al. | |
| 5,860,590 | A | | 1/1999 | Blomfield et al. | |
| 5,947,292 | A | | 9/1999 | Chelfi | |

FOREIGN PATENT DOCUMENTS

| | | |
|---|---|---|
| NL | 216732 | 9/1989 |

* cited by examiner

*Primary Examiner*—Gary E. Elkins
(74) *Attorney, Agent, or Firm*—Norman M. Cameron

(57) ABSTRACT

A ventilated container includes a rectangular bottom panel and first and second end panels connected to the bottom panel which extend outwardly therefrom. There are first and second side panels connected to the bottom panel which also extend outwardly therefrom. The side panels are connected to adjacent end panels. Each of the side panels has a longitudinal passageway extending therethrough from the first end panel to the second end panel to permit air to pass from the first end panel to the second end panel. When the containers are stacked in two adjacent rows, air can pass through the passageways from the first row to the second row to cool and ventilate contents of the containers. Alternatively the passageway may be in an end panel.

17 Claims, 7 Drawing Sheets

CONTAINER WITH LONGITUDINAL PASSAGEWAYS

BACKGROUND OF THE INVENTION

This invention relates to containers typically used for grapes, other types of produce or products which require ventilation or cooling.

Certain types of products, such as grapes, other types of produce or flowers, require cooling or ventilation prior to shipping or during shipping of the product. For example, grapes may be harvested at relatively high temperatures of 20°–30° Celsius. However they would suffer considerable loss of quality or deterioration if shipped at that temperature. Consequently, the grapes may be cooled prior to shipment or during shipment to maintain the grapes in good condition until they reach the consumer.

For example, grapes are frequently shipped in containers typically made of plastic, wood or corrugated paperboard. The latter material is highly desirable from the point of view of recycling the containers. When the grapes reach the destination point, corrugated containers can be flattened and sent back to a recycling depot for repulping. However, in the past, corrugated paperboard containers have permitted less than optimal cooling rates. This may cause a significant bottleneck at the vineyards or packing houses where the grapes must be cooled after harvesting before shipment.

For example, one method of cooling the grapes is to stack the containers adjacent each other in a room. Cooling air is forced through the stack of containers containing grapes by large cooling fans. The stacked containers must remain in place until the grapes are cooled to a particular temperature. Grapes often are harvested rapidly when conditions are right. However additional containers of grapes cannot be cooled or subsequently shipped until the containers containing grapes already in the cooling room reach the desired temperature.

It has been recognized in the prior art that the cooling of grapes or other products can be facilitated by placing openings in the containers so as to promote circulation of the cooling air about the product. For example, U.S. Pat. No. 4,770,339 to Weimer discloses a ventilated, stackable grape box. The sides and ends of the container have openings to facilitate venting.

U.S. Pat. No. 5,593,087 to Ross et al. discloses a container having an open top and stacking projections near the corners at the top which engage corresponding recesses in the bottoms of similar containers when stacked. Similar stacking tabs and recesses are employed in U.S. Pat. No. 5,002,224 to Muise.

A one-piece grape box is disclosed in U.S. Pat. No. 5,370,303 to Fry.

Other ventilated shipping containers are disclosed in U.S. Pat. No. 4,709,852 to Stoll, U.S. Pat. No. 5,458,283 to Southwell et al., U.S. Pat. No. 5,690,275 to Bose et al., U.S. Pat. No. 5,947,292 to Chelfi and U.S. Pat. No. 5,890,590 to Blomfield et al.

However, while some prior art containers have a plurality of openings for ventilation, they do not ensure sufficient flow of air when the containers are stacked. For example, the containers may be stacked in an arrangement where adjacent rows have the containers arranged at right angles to each other. This is often done so that the containers fit on standard pallets required for shipment by truck or ship. When this occurs, the containers of the second row may block openings in the containers of the first row, which is the row closest to the source of ventilating air. The result is an inadequate flow of cooling air through the containers which considerably slows the cooling rate.

Accordingly, it is an object of the invention to provide an improved container for produce or the like with better ventilation than prior art containers.

It is another object of the invention to provide an improved corrugated paperboard container which can satisfactorily replace wooden containers used for grapes or other produce.

It is a further object of the invention to provide an improved corrugated paperboard container which is rugged and rigid in construction and economical to produce and sell.

SUMMARY OF THE INVENTION

In accordance with these objects, there is provided, according to one aspect of the invention, a ventilated container having a rectangular bottom panel. First and second end panels are connected to the bottom panel and extend outwardly therefrom. First and second side panels are also connected to the bottom panel and extend outwardly therefrom. The side panels are connected to adjacent end panels. A first side panel has a first longitudinal passageway extending therethrough from the first end panel to the second end panel to permit air to pass from the first end panel to the second end panel.

Preferably the end panels have first apertures aligned with the first passageway, whereby the first passageway communicates through the end panels.

In one example the second side panel has a second longitudinal passageway extending therethrough from the first end panel to the second end panel and the end panels have apertures aligned with the second passageway whereby the second passageway communicates outwardly through the end panels.

Alternatively the passageways may be in the end panels.

There is provided, according to another aspect of the invention, a blank for forming a container. The blank has a central, bottom panel. End panels are connected to opposite ends of the bottom panel along parallel fold lines. Side panels are connected to opposite sides of the bottom panel along parallel fold lines. Each side panel has a first section adjacent to the bottom panel, a second section located outwardly therefrom and a connecting section extending between the first section and the second section. When the blank is folded along the fold lines of the side panels, each of the side panels is double walled with a passageway between the first section and second section thereof. Alternatively the end panels may have a first said section, a second said section, and a said connecting section such that the end panels are double walled with passageways therein.

There is provided, according to a further aspect of the invention, an apparatus for assisting cooling of produce. The apparatus includes a plurality of containers. Each container has a bottom, a first side, a second side, a first end, a second end and a longitudinal air passageway extending through the first side from the first end to the second end. The containers are arranged in a first row and a second row which is adjacent to the first row. The first row is arranged with the sides of the containers adjacent to each other and the second row is arranged with the ends of the containers adjacent to each other and with corresponding sides thereof adjacent to the second ends of the containers of the first row. The corresponding sides of the containers of the second row have openings aligned with the passageways of the containers of the first row, whereby air passing through the passageways of the containers of the first row can enter the containers of the second row through said openings. Alternatively the passageways may be in the ends of the containers.

According to a still further aspect of the invention, there is provided a method of folding a corrugated paperboard blank having a bottom panel, opposite side panels and opposite end panels, said side panels and said end panels being connected to the bottom panel. The method comprises folding at least one of the side panels to form a passageway therethrough extending between the end panels. Alternatively at least one of the end panels may be folded to form a passageway extending between the side panels.

According to a still further aspect of the invention, there is provided a method of stacking produce containers. Each container has a bottom, a first side, a second side, a first end, and a second end, the sides and the ends being connected to the bottom, the sides having longitudinal passageways extending therethrough. The containers are stacked vertically in a first stack of horizontal rows and a second stack of horizontal rows, the first stack having sides of the containers adjacent to each other, the second stack having ends of the containers adjacent to each other with the first sides of the containers of the second stack being adjacent to the second ends of the containers of the first stack and with the openings in the first sides of the containers of the second stack being aligned with the passageways through the sides of the containers of the first stack. Alternatively the passageways may be in the ends of the containers and the containers stacked so the passageways in the first stack align with openings in the ends of the second stack.

According to a still further aspect of the invention, there is provided a method for assisting cooling of produce. The method includes stacking a plurality of produce containers in first and second stacks. Each container has a bottom, a first side, a second side, a first end, and a second end, the sides and the ends being connected to the bottom, the sides having longitudinal passageways extending therethrough. The containers are stacked vertically in a first stack of horizontal rows and a second stack of horizontal rows, the first stack having sides of the containers adjacent to each other, the second stack having ends of the containers adjacent to each other with the first sides of the containers of the second stack being adjacent to the second ends of the containers of the first stack and with the openings in the first sides of the containers of tie second stack being aligned with the passageways through the sides of the containers of the first stack. Alternatively the passageways may be in the ends of the containers and the containers stacked so the passageways in the first stack align with openings in the ends of the second stack.

DETAILED DESCRIPTION OF THE PREFERRED EMBODIMENTS

Figure 1:
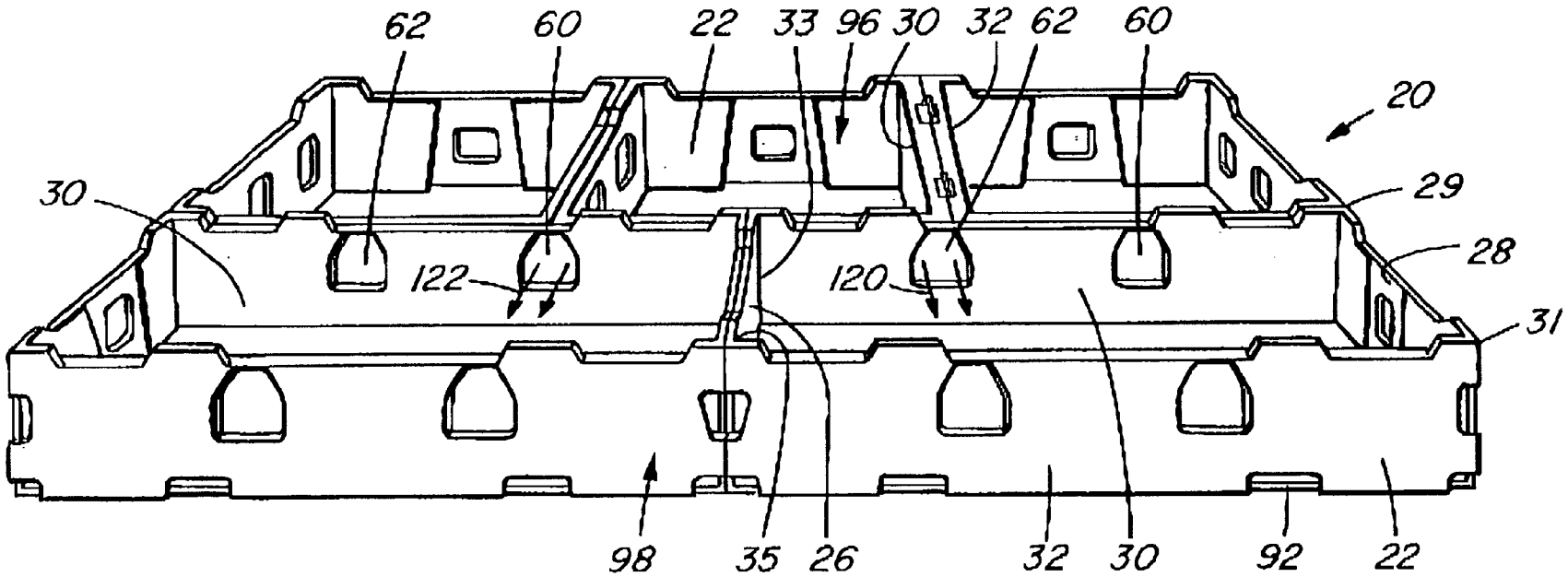
FIG. 1 is a perspective view of an apparatus for cooling grapes or other produce including a plurality of containers according to a first embodiment of the invention.
Figure 2:
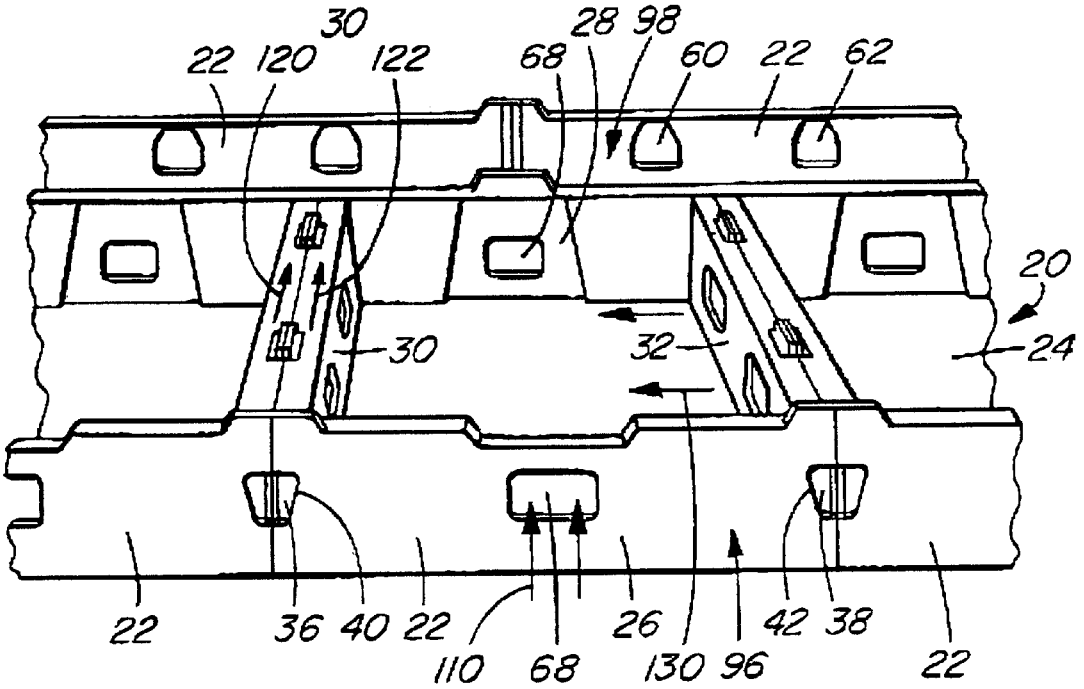
FIG. 2 is a perspective view of the apparatus of FIG. 1, shown from the opposite side thereof.

Referring to the drawings and first to FIG. 1–FIG. 4, these show an apparatus 20 for assisting the cooling or ventilating grapes, other produce or other perishable items. The apparatus includes a plurality of identical containers 22, five of which are shown in FIG. 1 and FIG. 2. As shown also in FIG. 6–FIG. 9, each of the containers has a rectangular bottom panel 24, a first upright panel 30, a second upright panel 32, a third upright panel 26 and a fourth upright panel 28. In this example panels 30 and 32 are first and second side panels respectively while panels 26 and 28 are first and second end panels respectively. The upright panels in this example are perpendicular to the bottom panel but they may extend at a different angle in other embodiments. The first and second side panels 30 and 32 are connected to the first and second end panels 26 and 28 at corners 29, 31, 33 and 35 of the container as shown for the right, front container of FIG. 1. The container 22 is open-topped though the invention is applicable a well to containers with tops. In this context, "rectangular" with reference to the bottom also includes square bottoms.

Figure 8:
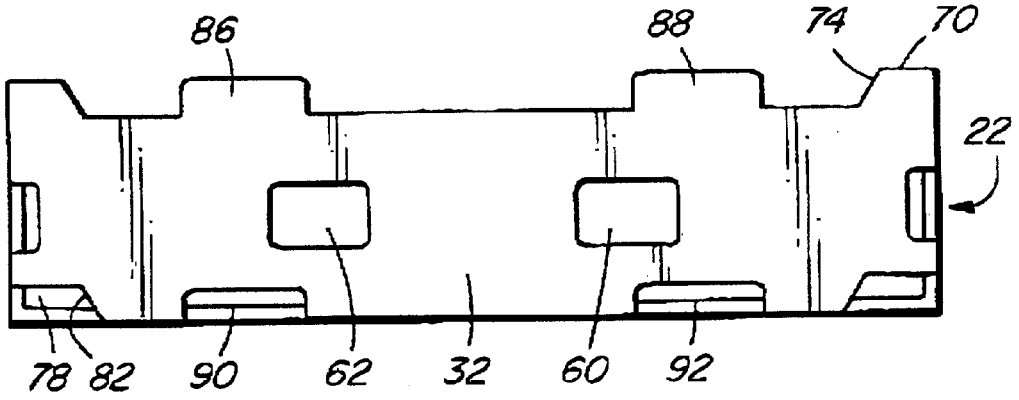
FIG. 8 is a side view thereof.

Each side panel of this embodiment has a longitudinal passageway extending therethrough. Side panel 30 has a passageway 36, while side panel 32 has a passageway 38. The passageways extend from the first end panel 26 to the second end panel 28 to permit air to pass from the first end panel to the second end panel through each side of the container. In this example each side panel has a passageway although in alternative embodiments only a single side panel may have a passageway. The passageways in this embodiment are triangular as seen in FIG. 8. However the passageways could be alternative shapes in other embodiments. Also the passageway or passageways may be in one or more end panels instead of, or in addition to, passageways in one or more side panels.

Figure 3:
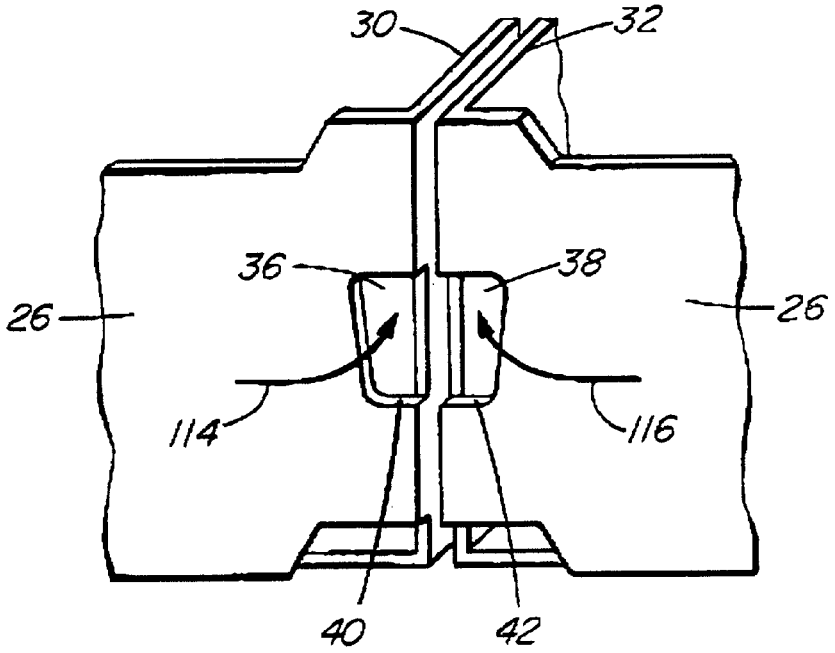
FIG. 3 is a fragmentary, enlarged end view of two of the containers thereof.
Figure 4:
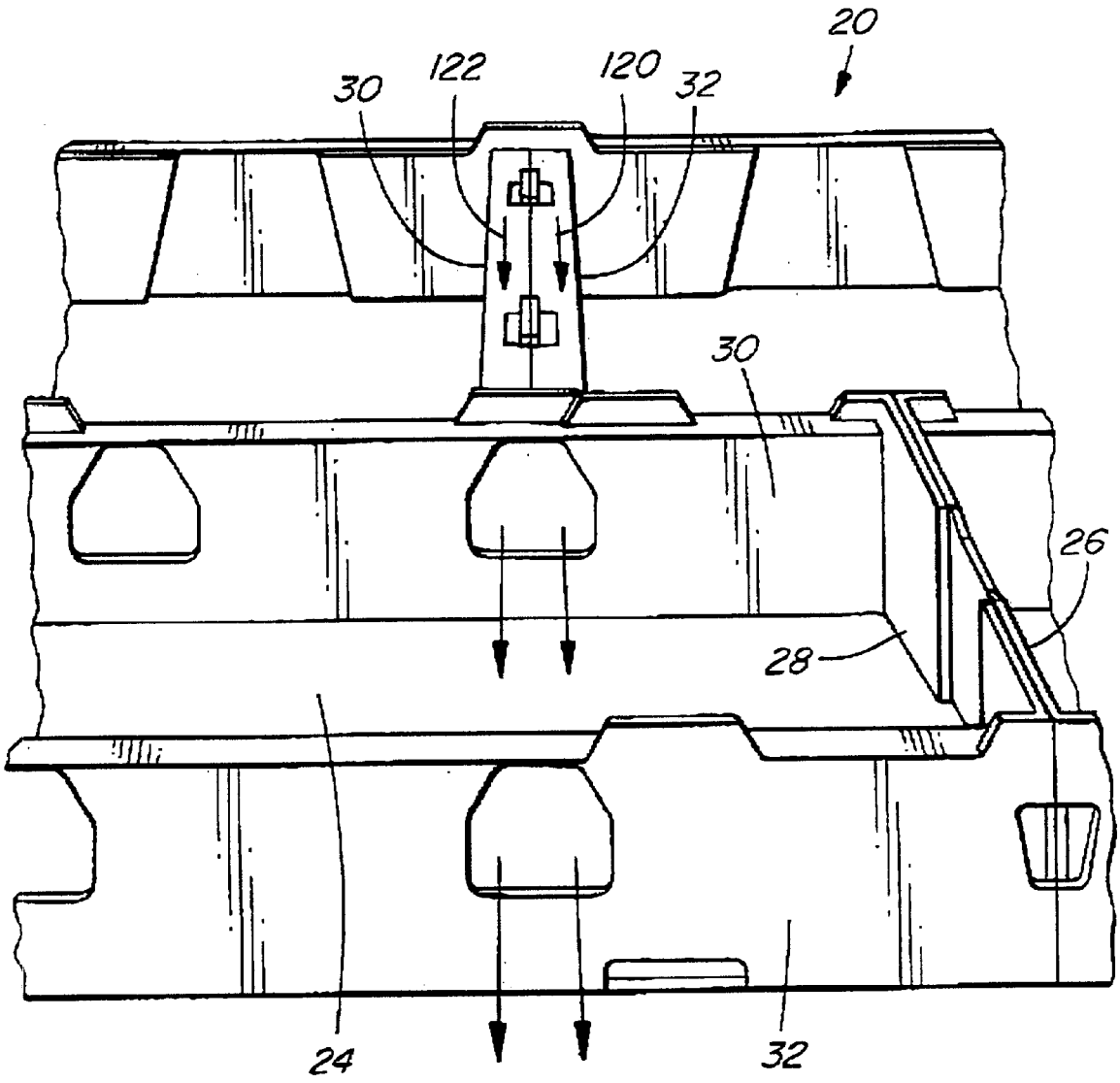
FIG. 4 is an enlarged, fragmentary view showing portions of four of the containers of FIG. 3.
Figure 6:
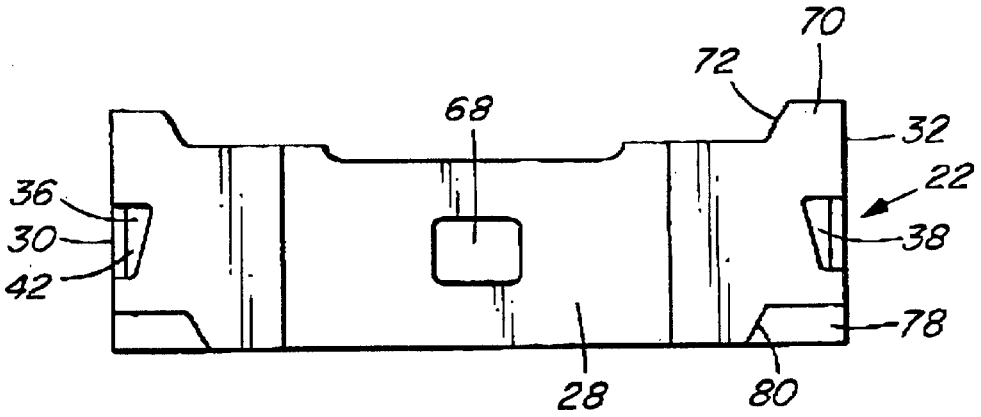
FIG. 6 is an end view of one of the containers of FIG. 1–FIG. 4.

As shown best in FIGS. 3 and 6, each end panel has an aperture 40 which is aligned with passageway 38 of side panel 32 and an aperture 42 aligned with the passageway 36. In this manner, the passageways communicate outwardly through the end panels.

Figure 9:
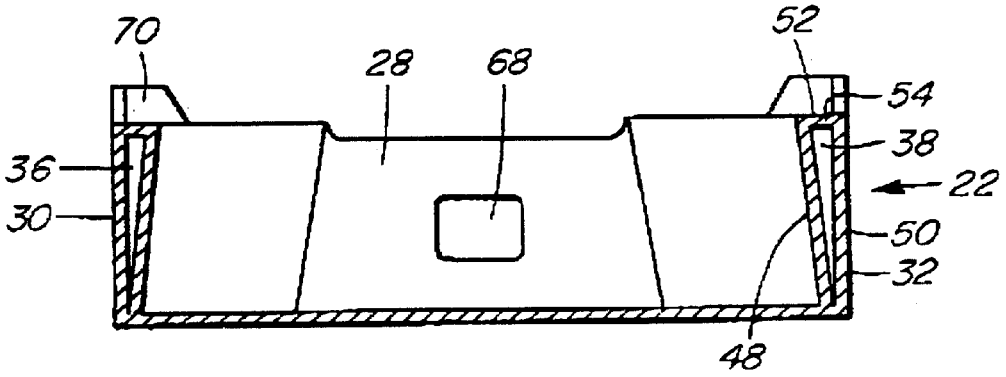
FIG. 9 is a sectional view taken a along line 9—9 of FIG. 7.

As shown best in FIG. 9, each of the side panels 30 and 32 includes an inner wall 48 and an outer wall 50 as shown for side panel 32. These are spaced-apart to form the passageways 36 and 38. Each of the side panels has an upper edge 52. The inner wall 48 and the outer wall 50 are spaced-apart adjacent the upper edge. There is a connecting wall 54 which connects the inner wall 48 and the outer wall 50 adjacent to the upper edge. This connecting wall forms the third side of the triangular passageways 36 and 38.

As seen best in FIG. 8, each of the side walls has a pair of apertures 60 and 62 extending through both the inner wall and the outer wall thereof. In alternative embodiments there may be fewer or more such apertures. Bottom 24 has a plurality of apertures 66, shown in FIG. 7, which likewise assist in cooling. There are four such apertures in this embodiment although the number can vary. Similarly each of the end panels has an aperture 68 as seen for end panel 28 in FIG. 9 and for end panel 26 in FIG. 6.

Figure 7:
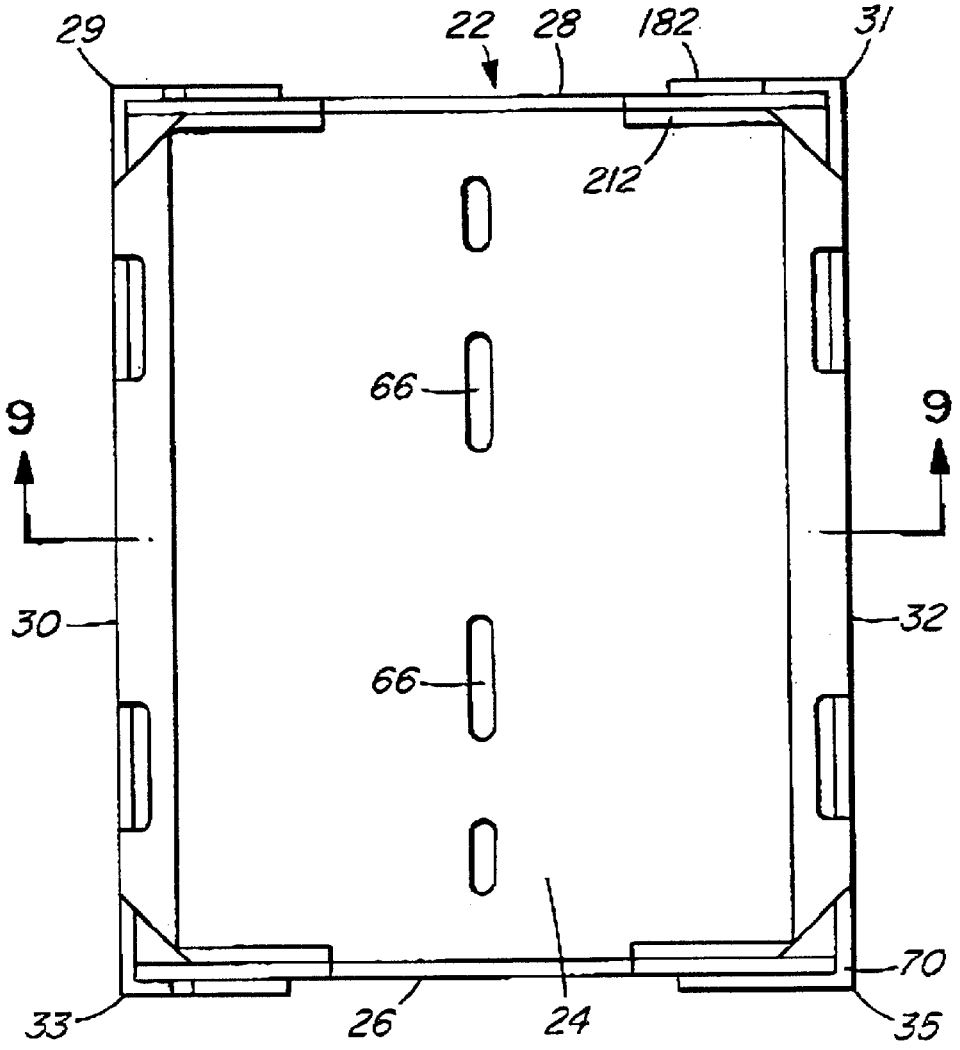
FIG. 7 is a plan view thereof.

The container has an upward projection 70 at each corner which is L-shaped when seen in plan in FIG. 7. Each of these projections has a pair of sloped edges 72 and 74 in this example as shown in FIGS. 6 and 8. There are corresponding, similarly shaped recesses 78 at each corner of each container below each projection 70. The recesses have similar shapes to the projections so that the containers lock together when stacked upon each other. Each of the recesses 78 has sloped edges 80 and 82, shown in FIGS. 6 and 8, corresponding to sloped edges 72 and 74 of the projections 70. The sloped edges assist in fitting the containers together when they are stacked one upon the other as shown in FIG. 10.

Each side of the container has a pair of upward projections 86 and 88, shown in FIG. 8, which are generally rectangular in shape with rounded corners. There are similar shaped recesses 90 and 92 on each side below the projections 86 and 88. These mating projections and recesses also assist is locking the containers together when they are stacked one upon the other.

Figure 10:
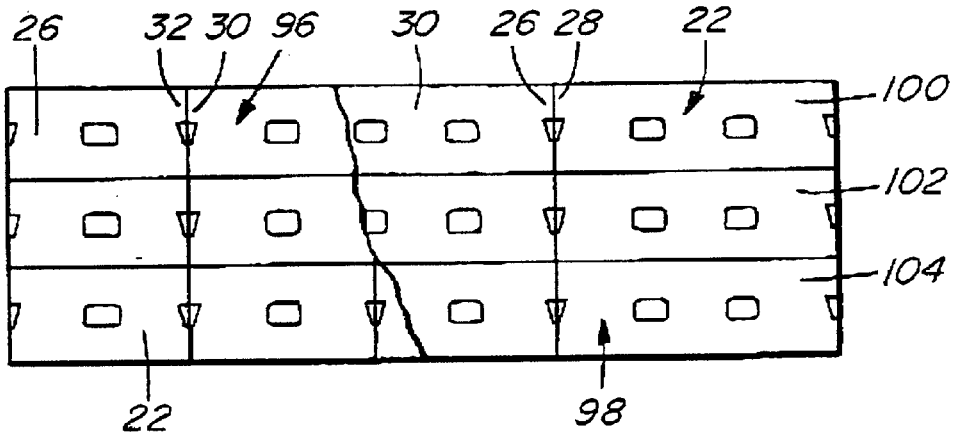
FIG. 10 is a side view of two adjacent stacks of containers according to FIG. 1–FIG. 9 and, the front stack being partly broken away to show part of the stack behind.

FIG. 10 shows a plurality of containers 22 which are arranged in two stacks 96 and 98, each stack having in this example three horizontal rows 100, 102 and 104 of containers. The containers of stack 96 are arranged with sides 30 and 32 of the containers adjacent to each other and with their first ends 26 facing outwardly. The second stack 98, located behind the first stack 96, is arranged with ends 26 and 28 of the containers adjacent to each other and with sides 30 thereof adjacent to the second ends 28 (not shown in FIG. 10) of the containers of the first row.

FIG. 1 shows three containers of a single row of stack 96 and two containers of a single row of stack 98. These are shown in FIG. 2 from the opposite side. Ends 26 of the containers of stack 96 face the source of ventilating air, typically a cooling fan. This air enters each of the containers 22 in stack 96 through the opening 68 in end panels 28 as indicated by arrows 10. However, more significantly, cooling air enters passageways 36 and 38 of the sides 30 and 32 through apertures 40 and 42 in each of the end panels 26. This is illustrated by arrows 114 and 116 in FIG. 3. The cooling air passes through the passageways towards the second ends 28 of the containers as illustrated by arrows 120 and 122 in FIG. 2.

As may be seen in FIG. 1, each of the side walls has apertures 60 and 62 positioned so that one of these apertures aligns with apertures 40 and 42 in the end walls and accordingly with the passageways 36 and 38 in the side walls of the containers of stack 96. The apertures 40 and 42 are not seen in FIG. 1, but it may be seen that aperture 62 in the right container 22 is aligned with side walls 30 and 32 of the two right end containers 22 of row 96. Thus air passing through the passageways in the side walls 30 and 32 of these containers can pass through the aperture 62 as indicated by arrows 120 in FIG. 1. Likewise arrows 122 illustrate the flow of air out of aperture 60 on wall 30 of the left container in stack 98.

The ventilating air entering the passageways 36 and 38 of the containers of stack 96 is permitted to enter the containers 22 of the stack through the apertures 60 and 62 as indicated by arrows 130 in FIG. 2.

Figure 5:
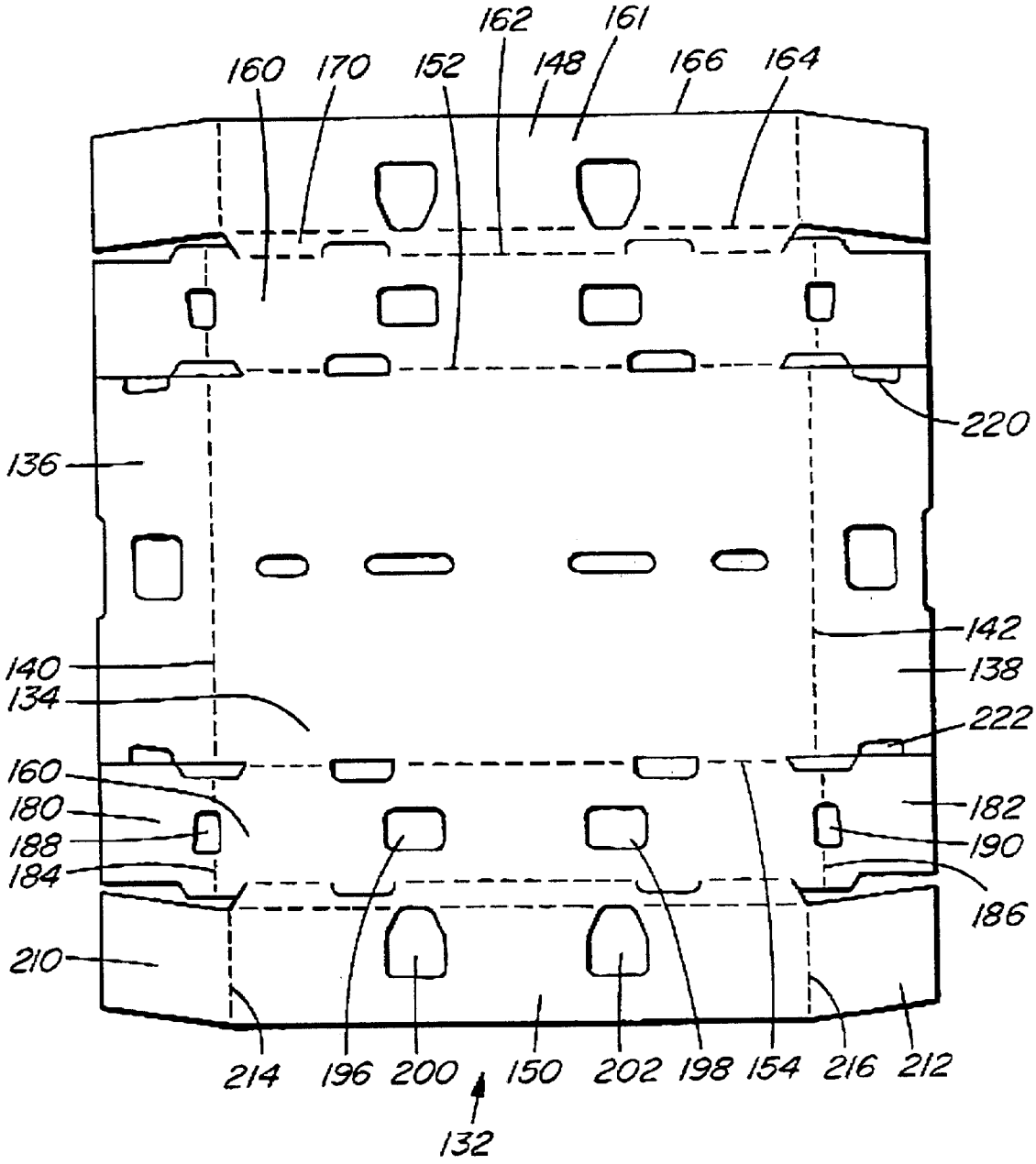
FIG. 5 is a plan view of a blank of corrugated paperboard for forming one of the containers of FIG. 1–FIG. 4.

FIG. 5 shows a corrugated paperboard blank 132 for forming each container 22. Each blank has a rectangular bottom panel 134 which forms the bottom 24 of the container as shown in FIG. 6. There are end panels 136 and 138 which are connected to opposite ends of the bottom panel along parallel fold lines 140 and 142. In this example the fold lines are formed by spaced-apart slits in the layers of paper of the corrugated paperboard forming blank 132.

There are side panels 148 and 150 connected to opposite sides of the bottom panel along parallel fold lines 152 and 154. Each of the side panels has a first section 160, as shown for panel 148, defined by fold line 152 and another fold line 162. A second section 161 is defined by fold line 164 and outer side edge 166 of the blank. It may be seen that the first and second sections of each side panel are spaced-apart by a connecting section 170 located between sections 160 and 161. When the blank is folded along the fold lines 152, 162 and 164, the first section 160 and the second section 161 of each of the side panels forms outer wall 50 and inner wall 48 of the side panels of the container as shown in FIG. 9.

Each of the side panels, for example side panel 150 of FIG. 5, has a pair of first end flaps 180 and 182 at opposite ends of the first section 160. These are defined by fold lines 184 and 186 which are parallel to the fold lines 140 and 142 of the end panels. These flaps have openings 188 and 1903 which form the openings 40 and 42 shown in FIG. 3.

The first section of each side panel has openings 196 and 198 while the second section has aligned openings 200 and 202. These form openings 60 and 62 in the side panels when the container is folded along the fold lines to form the container as shown in FIG. 8.

The second section 161 of each of the panels has second end flaps 210 and 212 which are connected to the second section along fold lines 214 and 216 which are parallel to fold lines 184 and 186, but are spaced inwardly therefrom.

Each of the end panels has cut out portions 220 and 222, shown for panel 138 in FIG. 5, which align with passageways 36 and 38 when the carton is folded as shown in FIG. 9. These allow air to pass through the end panels into the passageways.

When the blank is folded to form the containers, the flaps 180 and 182 extend along the exterior of the end walls to strengthen the end walls as shown for flap 182 in FIG. 7. The flaps 210 and 212 extend along the insides of the end walls to strengthen the end walls as shown for flap 212 in FIG. 7.

The flaps are held in position in this embodiment by hot glue although other adhesives or fasteners could be employed. Likewise the inner walls 48 of the side panels, shown in FIG. 9, could be held in place at the bottoms by hot glue although glue or other fastening means is not used in the illustrated embodiment. Also other means such as adhesives, fasteners, tabs and slots or friction could be used.

Figure 11:
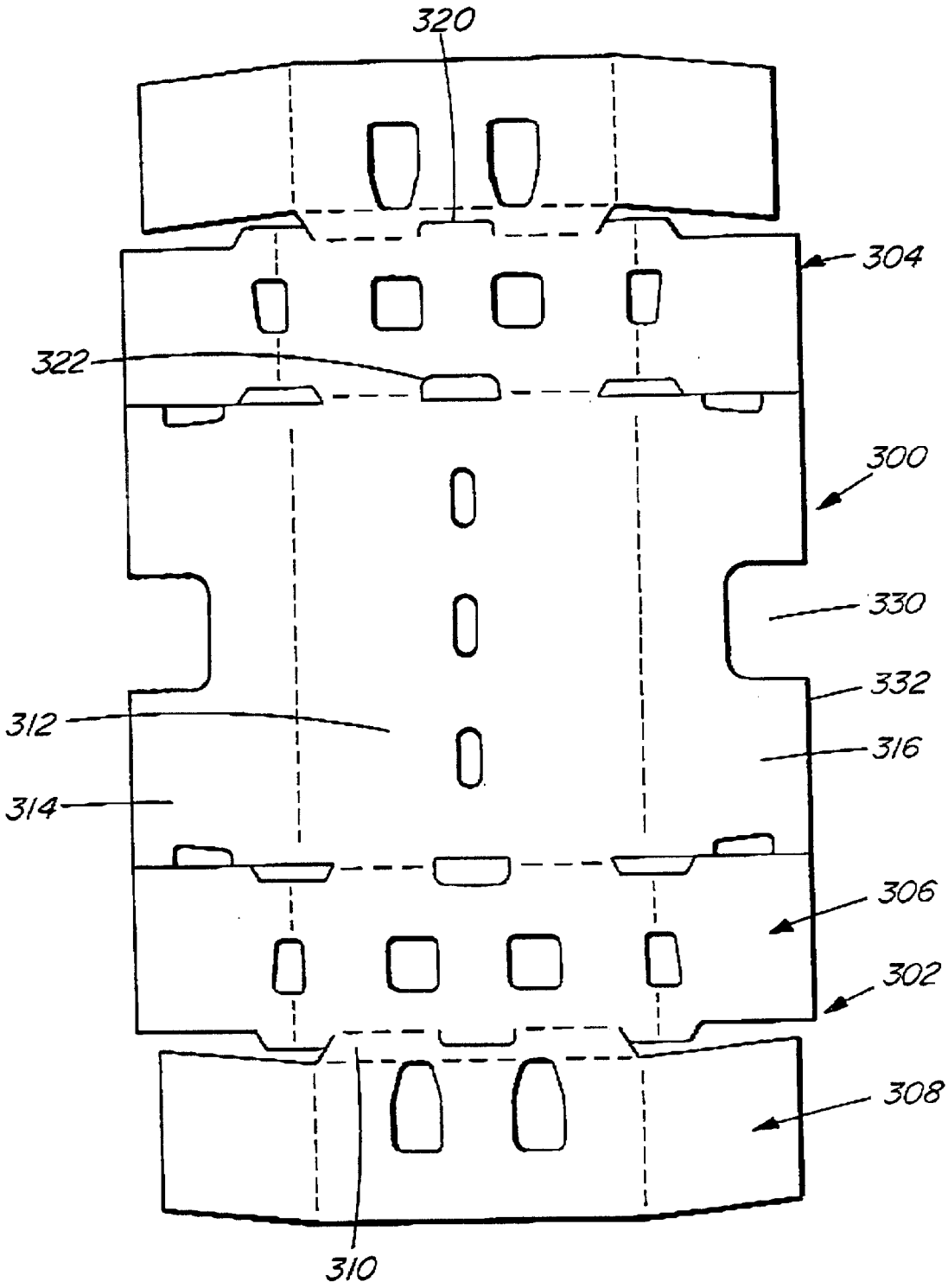
FIG. 11 is a plan view of a blank of corrugated paperboard for forming a container according to a further embodiment of the invention.

FIG. 11 shows a paperboard blank 300, according to an alternative embodiment of the invention, which is generally similar to the previous one and thus will be described only in relation to the differences. In this example, it is end panels 302 and 304 which have inner and outer sections 306 and 308 with connecting section 310 therebetween. Thus, when folded up, the passageways are in the end panels rather than the side panels as in the previous embodiment. The end panels are connected to bottom panel 32 along with side panels 314 and 316. Also there is but a single central, upward projection 320 on each end panel and a single corresponding recess 322. The openings 330 in the side panels are in the form of recesses extending inwardly from the top edges 332 thereof. Otherwise the structure is similar to the previous embodiment.

It will be understood by someone skilled in the art that many of the details described above are by way of example only and are not intended to limit the scope of the invention which is to be interpreted with reference to the following claims.

What is claimed is:

1. A ventilated container, comprising:

a rectangular bottom panel; and first, second, third and fourth upright panels connected to the bottom panel and extending outwardly therefrom, the first and second upright panels being parallel to each other and the third and fourth upright panels being parallel to each other and perpendicular to the first and second upright panels, the first and second upright panels being connected to the third and fourth upright panels at four corners of the container, the first upright panel having a first longitudinal passageway extending therethrough from the third upright panel to the fourth upright panel to permit air to pass from the third upright panel to the fourth upright panel, the third and fourth upright panels having first apertures respectively aligned with the first passageway, whereby the first passageway communicates through the third and fourth upright panels.

2. The ventilated container as claimed in claim 1, wherein the second upright panel has a second longitudinal passageway extending therethrough from the third upright panel to the fourth upright panel end the third and fourth upright panels have second apertures aligned with the second passageway whereby the second passageway communicates through the third and fourth upright panels.

3. The ventilated container as claimed in claim 2, wherein each of the first and second upright panels includes an inner wall and an outer wall, the passageways extending between the inner wall and the outer wall of each said first and second upright panel.

4. The ventilated container as claimed in claim 3, wherein the first and second upright panels are side panels and the third and fourth upright panels are end panels.

5. The ventilated container as claimed in claim 3, wherein the first and second upright panels are end panels and the third and fourth upright panels are side panels.

6. The ventilated container as claimed in claim 3, wherein each of the first and second upright panels has an upper edge, the inner wall and outer wall of each of the first and second upright panels being spaced-apart adjacent the upper edge, said each of the first and second upright panels having an upper connecting wall extending between the inner wall and the outer wall.

7. The ventilated container as claimed in claim 6, wherein the inner walls and outer walls have apertures extending therethrough.

8. The ventilated container as claimed in claim 6, wherein the first and second upright panels have spaced-apart first and second apertures extending therethrough, the first and second apertures of the first and second panels being positioned on the first and second upright panels such that, when a plurality of containers is arranged in a first row having a plurality of adjacent said containers aligned with their first and second upright panels in contact with each other and a second row having a plurality of adjacent said containers aligned with their third and fourth upright panels in contact with each other, the first row having corresponding third or fourth upright panels in contact with first or second upright panels of the containers of the second row, the first and second apertures in the third and fourth panels of the first row align with the first and second apertures on the first or second upright panel in contact therewith.

9. The ventilated container as claimed in claim 1, wherein the passageway is tubular.

10. A blank for forming a container, comprising:

a central, rectangular bottom panel;

first and second panels connected to the bottom panel along first and second, parallel fold lines;

third and fourth panels connected to the bottom panel along third and fourth parallel fold lines which are perpendicular to the first and second fold lines; and each said first and second panel having a first section adjacent to the bottom panel, a second section located outwardly therefrom and a connecting section extending between the first section and the second section, the connecting section being defined by parallel fold lines on opposite sides thereof between the connecting section, the first section and the second section respectively, whereby, when the blank is folded along said fold lines of the first and second panels, the first and second panels are each double walled with a passageway between the first section and the second section thereof, the third and fourth panels having cut out portion positioned to align with the passageways in the first and second panels when the first, second, third and fourth panels are folded along the fold lines, so the passageways in the first and second panels communicate through the third and fourth panels.

11. The blank as claimed in claim 10, wherein each of the first and second panels has first flaps at opposite ends thereof defined by fold lines extending parallel to the fold lines of the third and fourth panels, said first flaps having openings therein aligned with the passageways in the first and second panels and the cut out portions of the third and fourth panels, when the first, second, third and fourth panels are folded along the fold lines, so the passageways of the first and second panels communicate with the cut out portions of the third and fourth panels.

12. The blank as claimed in claim 11, wherein the first flaps are on the first section of each first and second panel, the second section of each first and second panel having second flaps at opposite ends thereof, the second flaps being connected to the second section along folds lines which are parallel to the fold lines of the first flaps, but spaced inwardly therefrom.

13. The blank as claimed in claim 12, wherein the openings of the first flaps are adjacent to the fold lines of the first flaps.

14. The blank as claimed in claim 11, wherein each said first and second panel has at least one cut out therein which is positioned to align with said cut out portions in the third and fourth panels when a plurality of said containers are arranged in a first row with third and fourth panels of adjacent containers in contact and a plurality of said containers are arranged in a second row with first and second panels of adjacent containers in contact, one of the first and second panels of the containers of the first row abutting corresponding third or fourth panels of the containers of the second row.

15. An apparatus for assisting cooling of produce, comprising:

a plurality of containers, each of said containers having a bottom, a first upright panel, a second upright panel, a third upright panel and a fourth upright panel, the first and second panels being parallel to each other and perpendicular to the third and fourth panels, a longitudinal air passageway extending through the first panel from the third panel to the fourth panel and extending through the third and fourth panels, the containers being arranged in a first row and a second row which is adjacent to the first row, the first row being arranged with the first and second panels of adjacent containers being adjacent to each other and the second row being arranged with the third and fourth panels of adjacent containers being adjacent to each other and with corresponding first or second panels thereof being adjacent to the fourth panels of the containers of the first row, the corresponding first or second panels of the containers of the second row having openings aligned with the passageways of the containers of the first row, whereby air passing through the passageways of the containers of the first row can enter the containers of the second row through said openings.

16. A method of stacking produce containers, each said container having a bottom panel, a first upright panel, a second upright panel, a third upright panel and a fourth upright panel, the panels being connected to the bottom panel, the first and second panels being parallel to each of other and the third and fourth panels being parallel to each other, the first and second upright panels having longitudinal passageways extending from the third panel to the fourth panel, each of the first and second panels having at least one opening extending therethrough, the containers being stacked vertically in a first stack of horizontal rows of containers and a second stack of horizontal rows of containers, the first stack having first and second panels of the containers adjacent to each other, the second stack having third and fourth panels of the containers adjacent to each other, with the first panels of the containers of the second stack being adjacent to the fourth panels of the containers of the first stack and with the openings in the first panels of the containers of the second stack being aligned with the passageways through the first and second panels of the containers of the first stack.

17. A method for assisting cooling of produce, comprising:

stacking a plurality of containers in first and second stacks, each of said containers having a bottom panel, a first upright panel, a second upright panel, a third upright panel and a fourth upright panel, the first and second panels being perpendicular to the third and fourth panels and being connected thereto at four corners of the container, a longitudinal air passageway extending through the first panel from the third panel to the fourth panel, the containers of the first stack being arranged with the first and second panels of the containers adjacent to each other and the second stack being arranged with the third and fourth panels of the containers adjacent to each other and with corresponding first or second panels thereof being adjacent to the third panels of the containers of the first stack, the corresponding panels of the containers in the second stack having openings aligned with the passageways of the containers of the first stack, whereby air passing through the passageways of the containers of the first stack can enter the containers of the second stack through said openings.

* * * * *